United States Patent [19]

Rump

[11] 4,449,470

[45] May 22, 1984

[54] HYDRAULIC CONTROL PACKAGE FOR A MARINE STEERING SYSTEM

[75] Inventor: Martin Rump, North Vancouver, Canada

[73] Assignee: Teleflex Incorporated, Limerick, Pa.

[21] Appl. No.: 349,734

[22] Filed: Feb. 18, 1982

[51] Int. Cl.[3] ..... B63H 25/22

[52] U.S. Cl. ..... 114/150; 440/61; 60/478; 60/486; 91/445; 251/367

[58] Field of Search ..... 91/420, 445, 446; 60/478, 473, 476, 486, 428; 114/150; 440/61; 244/78, 226; 251/367

[56] References Cited

U.S. PATENT DOCUMENTS

| | | | |
|---|---|---|---|
| 2,036,100 | 3/1936 | Richbourg | 60/486 |
| 2,287,960 | 6/1942 | Ballard | 91/420 |
| 2,657,539 | 11/1953 | Geyer | 244/226 |
| 2,809,596 | 10/1957 | Sullwold et al. | 60/478 |
| 3,233,407 | 2/1966 | Smith | 91/420 |
| 3,253,566 | 5/1966 | Jensen | 60/428 |
| 3,399,602 | 9/1968 | Klessig et al. | 91/446 |
| 3,508,400 | 4/1970 | Mercier | 114/150 |
| 3,576,192 | 4/1971 | Wood et al. | 91/420 |
| 3,773,082 | 11/1973 | Davis | 251/367 |

FOREIGN PATENT DOCUMENTS

| | | | |
|---|---|---|---|
| 593640 | 10/1947 | United Kingdom | 60/478 |

*Primary Examiner*—Trygve M. Blix

*Assistant Examiner*—Rodney Corl

*Attorney, Agent, or Firm*—Harold W. Milton, Jr.

[57] ABSTRACT

A hydraulic control package or assembly (30) for use in a marine steering system (10) having a steering helm pump (12) with port (14) and starboard (16) fluid outlets and a return inlet (18) for hydraulically actuating a piston (22) in a hydraulic cylinder (20) having port (24) and starboard (26) inlets for moving the piston (22) back and forth in the cylinder (20) in response to fluid delivered from the helm pump (12). A fluid reservoir (32, 34, 36) is closed and pressurized with air and is defined by an open ended tube (32) having a cap (34) sealing the top end of the tube (32) and a valve body (36) sealing the bottom end of the tube (32). The valve body (36) houses the control valve means for controlling the fluid flow in the system between the helm pump (12) and the actuating cylinder (20). The cap (34) and valve body (36) are held against the respective ends of the tube (32) by tie rods (50). The assembly may also include a plurality of steering pumps (12, 12') connected in parallel and through shuttle-tee check valves (120, 124) to the control valve means (36) with a restricted bypass (127, 128) extending about each shuttle-tee check valve for preventing the nonactive pump from motoring in response to steering fluid output of the active pump while allowing a limited amount of the steering fluid output to flow to the nonactive steering pump.

19 Claims, 5 Drawing Figures

HYDRAULIC CONTROL PACKAGE FOR A MARINE STEERING SYSTEM

TECHNICAL FIELD

The subject invention relates to a hydraulic control assembly or package for use in a marine steering system. Typically, a marine steering system includes a steering or helm pump attached to a steering wheel for directing fluid to opposite ends of an actuating cylinder which, in turn, actuates the rudder to effect steering of the boat.

As will be appreciated, there is quite a distance between the helm steering pump and the hydraulic actuating cylinder for moving the rudder. Typical of a prior art system is one which includes a reservoir positioned somewhere on the boat between the steering helm pump and the actuating cylinder. Frequently, the reservoir is pressurized with air so that the entire system is pressurized. In such systems air or gas may accumulate in the actuating cylinder and must be released or bleed off. Typically, manually actuated pressure relief valves are attached to each end of the cylinder and, when opened, relieve the gas at the end of the cylinder, which gas passes to the atmosphere or back to the reservoir. During the bleeding operation, the reservoir is disconnected from the system and, after the bleeding is completed, the relief valves are closed putting the reservoir back into the system.

The prior art systems also include various control valves for directing the fluid flow between the steering helm pump and the actuating cylinder.

Most such steering systems also include various filters for removing contaminants from the hydraulic fluid. Such filters frequently restrict the hydraulic fluid flow and, therefore, increase the effort required for steering.

STATEMENT OF INVENTION AND ADVANTAGES

The subject invention relates to a hydraulic control assembly for use in a marine steering system of the type having a steering pump with port and starboard fluid outlets and a return inlet with a steering cylinder having a piston therein and port and starboard inlets for hydraulically moving the piston back and forth in the cylinder in response to fluid delivered from the steering pump. A reservoir supplies fluid to the steering system and control valve means control fluid flow in the system. The assembly is characterized by including a tube having first and second open ends with a cap member in sealing engagement with the first end of the tube and a valve body in sealing engagement with the second end of the tube thereby defining a fluid reservoir with the valve body housing or including the control valve means.

Accordingly, there is provided a hydraulic control assembly which is one package and which may be pressurized and which provides continuous purging of air from the system. The hydraulic control assembly is one package having fittings which may be attached to the steering helm pump and the control cylinder respectively to provide a pressurized system having a makeup reservoir and including the control valve for directing the fluid flow in the system.

PRIOR ART STATEMENT

The subject invention utilizes a control valve operation of the type disclosed and claimed in U.S. Pat. No. 3,576,192 granted Apr. 17, 1971 in the name of Ray A. R. Wood et al and assigned to the assignee of the subject invention. Other control valve assemblies are known in the prior art for use in marine steering systems and a sample of same is illustrated in U.S. Pat. No. 3,233,407 granted Feb. 8, 1966 to Darcy Smith. The subject assembly differs from the prior art assemblies in that it is a unitary package including a closed reservoir combined with the control valves whereby a single package may be connected to the steering pump and the steering actuating a cylinder to provide all the required functions.

BRIEF DESCRIPTION OF THE DRAWINGS

Other advantages of the present invention will be readily appreciated as the same becomes better understood by reference to the following detailed description when considered in connection with the accompanying drawings wherein.

DESCRIPTION OF THE PREFERRED EMBODIMENT

Figure 1:
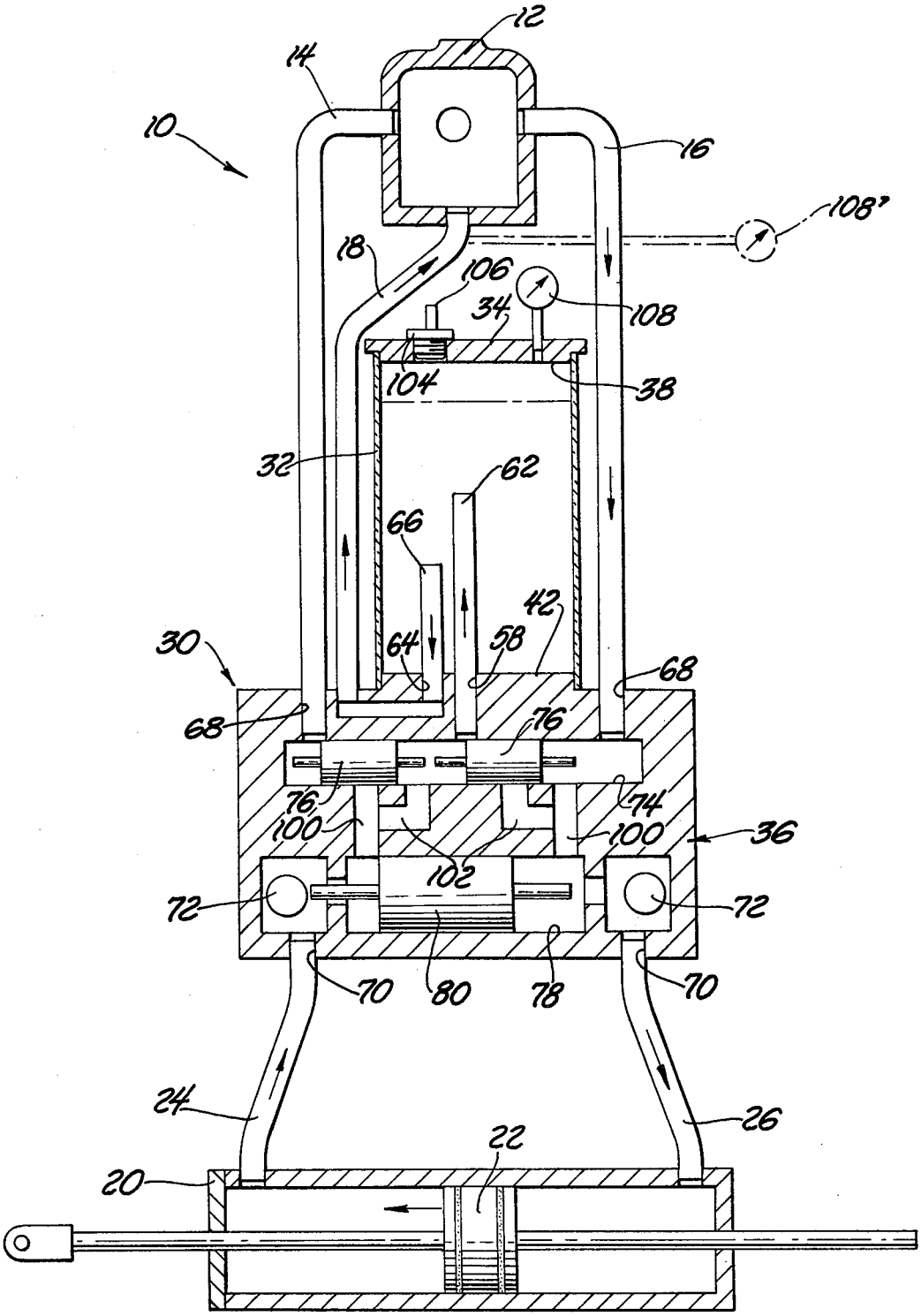
FIG. 1 is a schematic view illustrating a marine steering system utilizing the subject invention.
Figure 2:
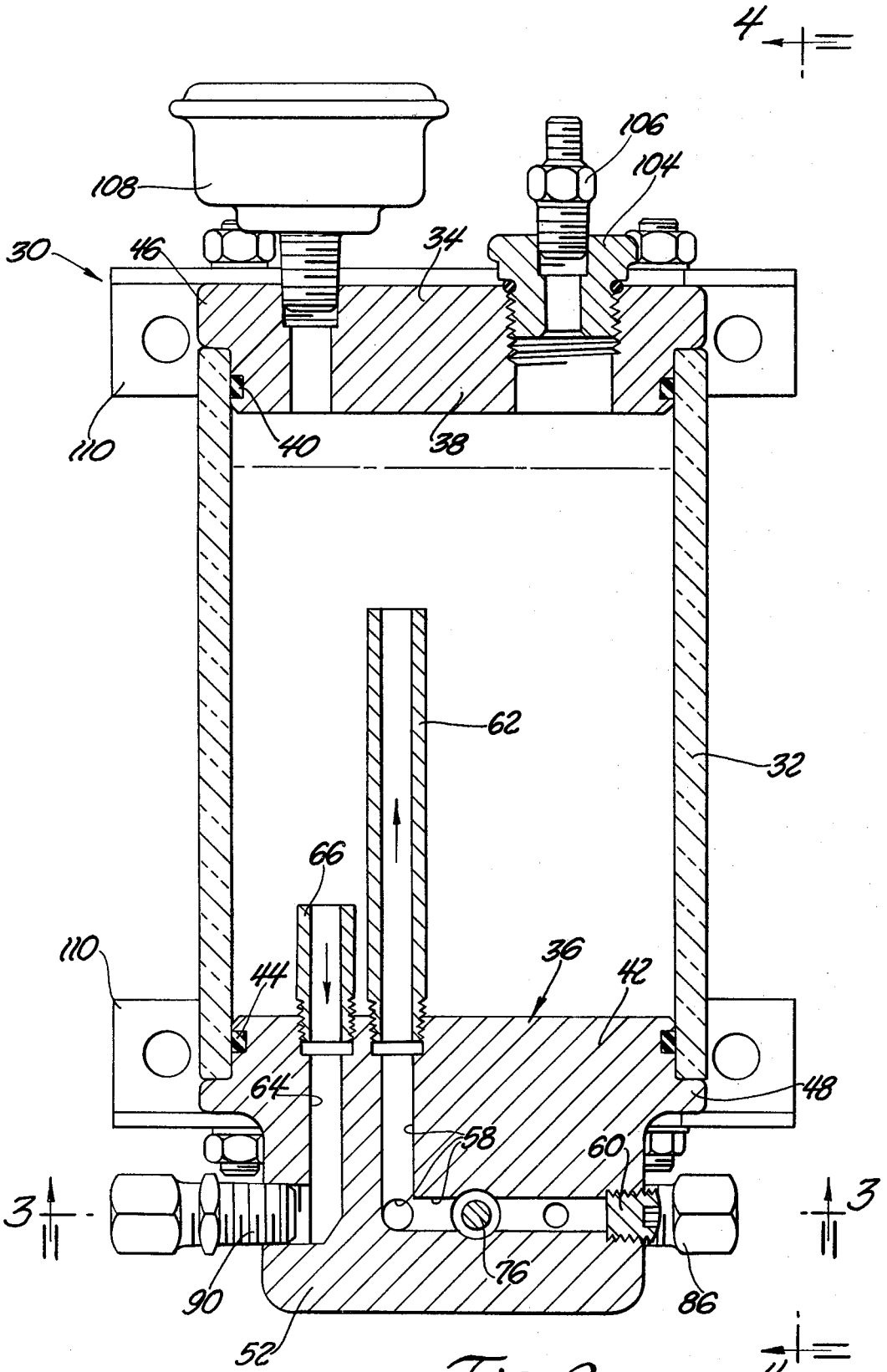
FIG. 2 is an enlarged cross-sectional view taken substantially along line 2—2 of FIG. 4.
Figure 3:
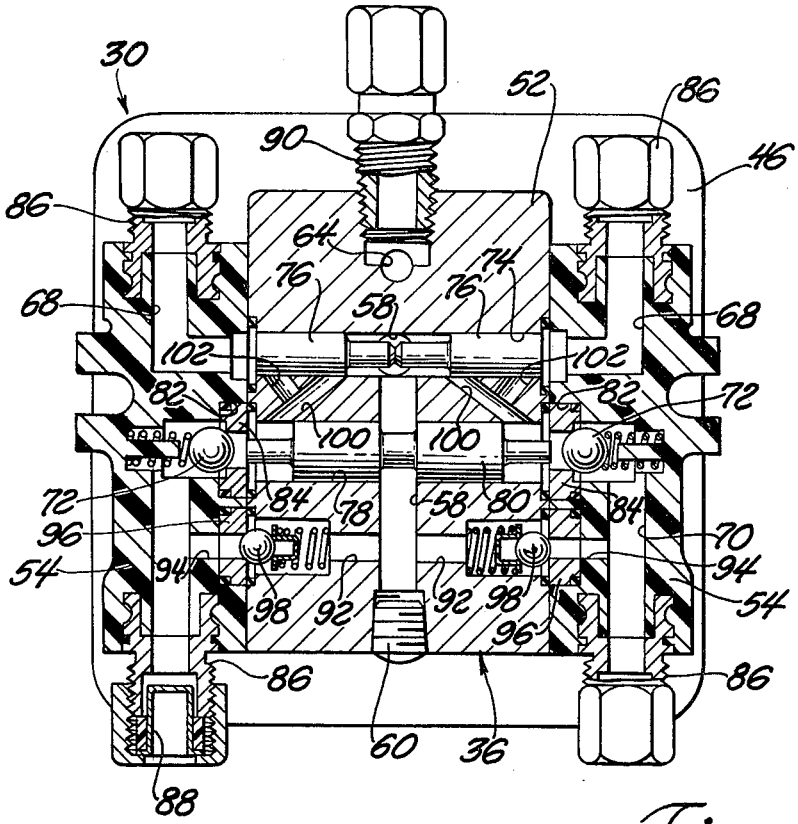
FIG. 3 is a cross-sectional view through the valve body taken substantially along line 3—3 of FIG. 2.

A marine steering system utilizing the hydraulic control assembly of the subject invention is generally shown at 10 in FIG. 1. The steering system 10 is of the type having a helm steering pump 12 with port and starboard fluid outlets 14 and 16, respectively, and return inlet 18.

The steering system 10 includes an actuating or steering cylinder 20 with an actuating piston 22 slidably disposed therein with port and starboard inlets 24 and 26, respectively, for moving the piston 22 back and forth in the cylinder 20 in response to fluid delivered from the steering pump 12.

The hydraulic control assembly of the subject invention is generally shown at 30. The assembly includes a reservoir for supplying fluid to the steering system 10. The reservoir includes a tube 32, preferably a cylinder made of clear acrylic having first and second open ends. A metal cap member 34 is in sealing engagement with the first or top end of the tube 32. A valve body, generally indicated at 36, is in sealing engagement with the second or bottom end of the tube 32 to define the fluid reservoir.

The hydraulic control assembly 30 also includes control valve means for controlling the fluid flow in the system 10 and the valve body 36 includes or houses the control valve means.

The cap member 34 includes a cylindrical or circular insert portion 38 extending into and in sealing engagement with the interior of the tube 32 adjacent the top end thereof. More specifically, an annular or circular seal 40 is disposed between the central insert 38 and the interior wall of the acrylic tube 32. In a similar fashion, the valve body 36 includes an insert portion 42 extending into and in sealing engagement with the interior of the tube 32 adjacent the bottom end thereof, there being an annular seal 44 disposed between the central insert portion 42 and the interior wall of the acrylic tube 32. The cap member 34 includes an abutment flange 46 which is square or four-sided to define round corners. The abutment flange 46 extends radially from the insert portion 38 and engages the end surface of the top of the tube 32. In a similar fashion, the valve body includes an abutment flange 48 which is square or four-sided to define round corners and extends radially from the insert portion 42 thereof to engage the bottom end surface of the tube 32.

A plurality of tie rods 50 interconnect the cap member 34 and the valve body 36 for urging the cap member 34 and the valve body 36 into engagement with the top and bottom ends of the tube 32. There are four tie rods 50 and each tie rod extends through one of the corners of the abutment flanges 46 and 48. The tie rods are threaded at each end and include nuts for tensioning the respective tie rods 50.

Figure 4:
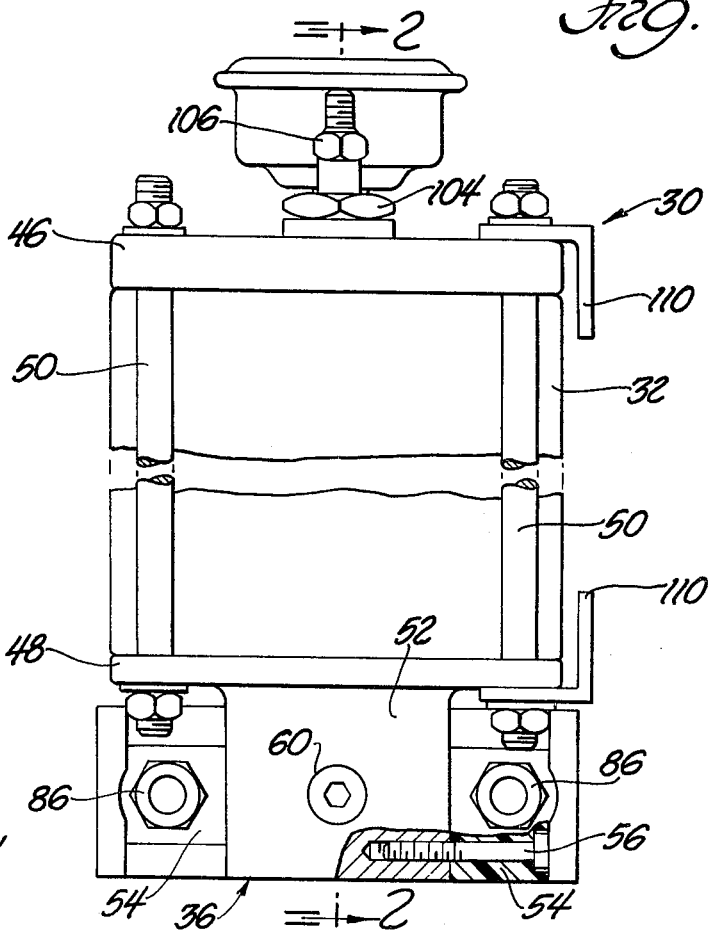
FIG. 4 is a side elevational view taken substantially along line 4—4 of FIG. 2 but of a smaller scale and partially broken away and in cross section.

The valve body 36 includes a central metal portion 52 extending from the abutment flange 48 thereof in a direction away from the bottom or second end of the tube 32. The valve body also includes a pair of identical side portions 54 extending along opposite sides of the central portion 52 and connected thereto by bolts 56, one of which is illustrated in FIG. 4. The side portions 54 are preferably made of a plastic, such as nylon. Thus, the side portions 54 are removably attached to the central portion 52 by bolts 56.

The central portion 52 includes a reservoir inlet passage 58 extending to a first opening into the tube 34. A portion of the reservoir inlet passage 58 is plugged by a threaded plug 60. A first control tube 62 is threaded into the opening of the reservoir inlet passage into the tube 32. The central portion 52 also includes a pump outlet passage extending from a second opening into the tube 32 to the pump return outlet line 18. A second control tube 66 is threaded into the opening for the pump outlet passage. The cap 34 forms the top of the reservoir and the valve body 36 forms the bottom of the reservoir. Accordingly, the control tubes 62 and 66 extend upwardly from the bottom of the reservoir tank into the reservoir. The first control tube 62 which provides an inlet into the reservoir tank of hydraulic fluid from the system is longer in length than the second control tube 66 forming the exit tube to the steering pump inlet 18. Accordingly, contaminants in the hydraulic fluid entering the tube 62 will be dispersed throughout the hydraulic fluid in the reservoir tank to fall to the bottom or settle on the bottom of the reservoir about the control tubes 62 and 66 so as to be prevented from entering the pump outlet control tube 66. In other words, the end of the tube 66 is high enough above the bottom of the tank so that contaminants settled on the bottom of the tank will not enter the tube 66 and the system. The arrangement of the tubes 62 and 66, therefore, eliminates the need for a filter in the system which could increase the steering resistance.

Each of the side portions 54 includes a pump inlet passage 68 communicating with the central portion 52 for receiving fluid from the pump outlets 14 and 16, respectively. Each of the side portions 54 also includes a cylinder passage 70 for establishing fluid communication between the central portion 52 and one of the steering cylinder inlets 24 and 26. A check valve 72 is disposed in each cylinder passage 70 in each of the side portions 54.

The central portion 52 has a shuttle bore 74 extending completely therethrough between the side portions 54 and communicating with the pump inlet passages 68. A shuttle valve means or members 76 are slidably disposed in the shuttle bore 74 for controlling the fluid flow therethrough. The central portion also has a spool bore 78 extending therethrough between the side portions 54 and communicating with the cylinder passages 70. A spool valve means or member 80 is slidably disposed in the spool bore to perform a controlling function.

Each of the side portions 54 includes a first pocket 82 therein about the cylinder passage 70 and facing the spool bore 78 at the end thereof. A first valve seat 84 is disposed in each pocket 82 and engages the side of the central portion 52. The check valve 72 includes a round ball disposed in the cylinder passage 70 with a spring associated therewith and disposed around a projection in the side portion for reacting between the side portion 54 and the ball for urging the ball into and in sealing engagement with the associated valve seat 84.

As alluded to above, the side portions 54 are preferably made of a plastic, such as nylon, and include metal connectors or fasteners 86 at each of the pump inlet passages 68 and at each of the cylinder passages 70. Each connector or fitting 86 has one end completely embedded in the plastic material of the side portions 54 with the other end extending therefrom and adapted by nuts to be connected to a fluid line. Specifically, the connectors are of the type into which the end of a tube is inserted with the connectors being tightened down to force an annular flexible seal into engagement with the exterior of the tube. As shown, each of the connectors includes an insert 88 which prevents contaminants from entering into the system during shipment, the insert 88 being removed prior to attaching the end of a tube to the connector. A similar connector 90 threadedly engages the central portion 52 of the valve body and similarly attaches to a fluid line 18 leading to the helm pump 12.

The central portion 52 has a relief cavity 92 extending therethrough between the side portions 54. Each side portion 54 has a relief passage 94 communicating between the cylinder passage 70 and the relief cavity 92 in the central portion 52. Each side portion 54 has a second pocket therein about the relief passage 94 and facing the relief cavity 92 for receiving a second valve seat 96. Each valve seat 96 is disposed in the pocket and engages the side face of the central portion 52. A relief valve assembly 98 is disposed in each of the opposite ends of the relief cavity 92 and includes a spring biased ball engaging the second valve seat 96.

The central portion 52 includes the passages 100 and 102 communicating between the shuttle bore 74 and the spool bore 78 with the openings thereof being controlled by the shuttle valve members 76. As described hereinbefore, a portion of the reservoir inlet passage 58 is a passage extending between the relief cavity 92 and the reservoir inlet.

The spool valve 80 includes extensions extending from each end thereof for opening the check valves 72.

As alluded to hereinbefore, the reservoir is closed and includes filling means defined by the plug 104 and the one-way inlet valve 106 in the top or cap 34 of the reservoir for filling the reservoir with hydraulic fluid and for pressurizing the reservoir with a gas such as air. The plug 104 may be threaded out of engagement with the cap 34 for introducing hydraulic fluid into the reservoir. The pressure inlet 106 is of the type utilized with pneumatic tires, such as automotive tires, for inflating tires. Also disposed in the cap member 34 is a pressure gauge means 108 for indicating the pressure in the system 10.

Instead of the pressure gauge 108 being connected to the cap member 34 or, in addition to the pressure gauge 108, a pressure gauge 108', as shown in FIG. 1, may be connected to the return line to the steering pump 12 with the gauge 108' actually being disposed on the instrument panel whereby the boat operator has an immediate indication of the system pressure.

The assembly also includes the brackets 110 which are held in place by tie rods 50 for attaching the assembly or mounting the assembly to a support structure.

The operation of the system is best illustrated in FIG. 1 wherein the pump 12 is providing pressure in the line 16 to the passage 68 in the valve body 36. The fluid pressure in the passage 68 acts upon the right-hand valve member 76 moving it to the left as indicated. Fluid pressure from the line 68 passes through the passage 100 to the spool bore 78. The fluid pressure in the bore 78 moves the spool valve 80 to the left whereby the check valve 72 on the left is opened, allowing return fluid flow from the cylinder 20 through the passage 102 on the left and into the tube 62 of the reservoir. Pressure on the right of spool valve 80 also opens the check valve 72 on the right to allow flow through the conduit 26 to the hydraulic cylinder 20 thereby moving the piston to the left, as illustrated. The pump 12, of course, is being fed hydraulic fluid from the reservoir through the tube 66 and the pump inlet 18.

If the direction of steering is reversed, the valves all move to the right in response to fluid pressure produced by the pump 12 in the pump outlet 14 and the components all work in reverse.

Although not shown schematically in FIG. 1, the system does include high pressure relief valves 98 which open the cylinder passages 70 to the relief cavity 92 and the passage 58 extending back to the reservoir inlet tube 62. In other words, if the pressure in the cylinder passage 70 becomes too high, the relief valves 98 will relieve the pressure to the reservoir.

Figure 5:
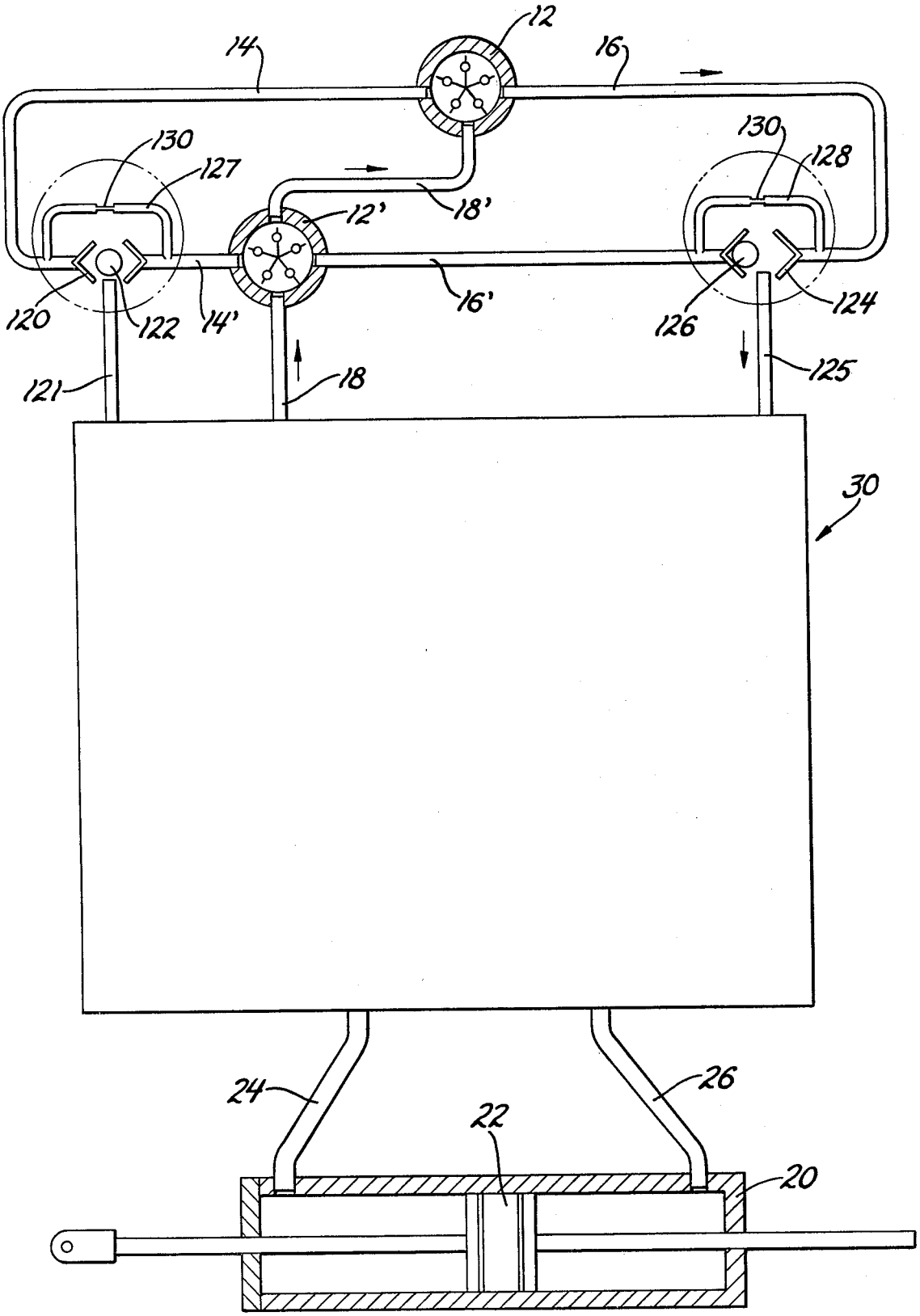
FIG. 5 is a schematic view showing a steering assembly of the subject invention including a plurality of steering pumps.

The assembly shown schematically in FIG. 5 includes the hydraulic control assembly 30. as described above, associated with the steering cylinder 20 with the port and starboard inlets 24 and 26. The system in FIG. 5 includes a second steering pump 12' having the port and starboard fluid outlets 14' and 16'. The line 18 is connected to the return inlet of the pump 12' with the pump 12' connected by line 18' to the return inlet of steering pump 12. The assembly of FIG. 5 includes flow divider means between the control valve means 36 and the steering pumps 12 and 12' for preventing the nonactive steering pump from motoring in response to steering fluid output of the active steering pump while allowing a limited amount of the steering fluid output to flow to the nonactive steering pump. More specifically, the flow divider means includes a first shuttle-tee check valve 120 having a first valve passage interconnecting the port outlets 14 and 14' of the steering pumps 12 and 12' and a first outlet 121 connected to the control valve means 36. A first ball valve member 122 is movable back and forth in the first valve passage to close the first valve passage to the port outlet 14 or 14' of the inactive pump in response to fluid output from the port outlet 14 or 14' of the active pump. In a similar fashion, the flow divider means includes a second shuttle-tee check valve 124 having a second valve passage interconnecting the starboard outlet 16 and 16' of the steering pumps 12 and 12' and a second outlet 125 connected to the control valve means 36. A second ball valve member 126 is movable back and forth in the second valve passage to close the second valve passage to the starboard outlet 16 or 16' of the inactive pump in response to fluid output from the starboard outlet 16 or 16' of the active pump.

In addition, the flow divider means includes a first bypass passage 127 interconnecting the port outlets 14 and 14' for allowing a restricted flow of fluid to bypass the first shuttle-tee check valve 120. Similarly, a second bypass passage 128 interconnects the starboard outlets 16 and 16' for allowing a restricted flow of fluid to bypass the second shuttle-tee valve 124. Each of the bypass passages 127 and 128 includes a calibrated flow control restriction to limit the volume flow rate to a predetermined range.

The two steering pumps 12 and 12' may be two pumps connected to a steering wheel or one of the steering pumps may be associated with an auto pilot. Assuming that the steering pump 12 is the active pump by being manually actuated for producing steering fluid pressure in the starboard outlet 16, the fluid will flow into the shuttle-tee check valve 124 moving the valve member 126 to the left, as illustrated, for preventing fluid flow through the shuttle-tee check valve 24 and into the starboard outlet line 16' leading to the second steering pump 12'. This will prevent the second steering pump 12' from motoring or turning in response to the output of the first steering pump 12. The output from the first steering pump 12 will pass through the shuttle-tee check valve 124 and out the outlet 125 thereof to the passage 68 in the control valve means 36, as hereinbefore described. At the same time, a restricted flow passes through the bypass passage 128 and the calibrated restriction 130 to the starboard outlet 16' of the nonactive pump 12'. This compensates for the residual pressure in the lines, particularly when the steering direction is changed frequently. If the active steering pump 12 is rotated in the opposite direction, the system would operate in reverse with the check ball member 122 moving to the right. Additionally, should the steering pump 12' become the active pump for an output in the starboard outlet 16', the check ball member 126 would move to the right and the bypass flow in the passage 128 would be in the reverse direction from outlet 16' to outlet 16.

In actual practice, when using 300 psi in the system, the restrictions 130 have been calibrated to allow a rate of flow in the predetermined range of between 50 and 150 milliliters per minute. If the bypass leakage in the passages 127 and 128 is too small, the two shuttle members or plungers 76 in the control valve means 36 could remain closed on both sides at the same time. If the bypass flow is too high, the nonoperated or inactive steering pump will motor or turn in response to activation of the other steering pump.

By utilizing the concept shown in FIG. 5, the steering pumps 12 and 12' need not have any valves whatsoever associated with them to control flow therethrough and soft lines may be used in the system.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims wherein reference numerals are merely for convenience and are not to be in any way limiting, the invention may be practiced otherwise than as specifically described.

The embodiments of the invention in which an exclusive property or privilege is claimed are defined as follows:

1. A hydraulic control assembly (30) for use in a marine steering system (10) of the type having a steering pump (12) with port and starboard fluid outlets (14, 16) and a return inlet (18), a steering cylinder (20) with a piston (22) therein and port and starboard inlets (24, 26) for hydraulically moving the piston (22) back and forth in the cylinder (20) in response to fluid delivered from the pump (12), said assembly (30) comprising; a fluid reservoir (32, 34, 36) for supplying fluid to said steering system (10) and control valve means for controlling fluid flow in said system, said assembly (30) being characterized by including a tube (32) having first and second open ends, a cap member (34) in sealing engagement with said first end of said tube, a valve body (36) in sealing engagement with said second end of said tube (32) to define said fluid reservoir, said valve body (36) including said control valve means, said valve body (36) including a central portion (52) extending in a direction away from said second end of said tube (32) and a pair of side portions (54) extending along opposite sides of said central portion (52) and being removably attached to said central portion (52), each of said side portions (54) including a cylinder passage (70) for establishing fluid communication between said central portion (54) and one of the steering cylinder outlets (24, 26), each of said side portions (54) including a pump inlet passage (68) communicating with said central portion (52) for receiving fluid from one of the pump outlets (14, 16), a check valve (72) disposed in said cylinder passage (70) in each of said side portions (54), said central portion (52) having a shuttle bore (74) extending therethrough between said side portions (54) and communicating with said pump inlet passages (68), shuttle valve means (76) slidably disposed in said shuttle bore (74), said central portion (54) having a spool bore (78) extending therethrough between said side portions (54) and communicating with said cylinder passages (70), spool valve means (80) slidably disposed in said spool bore (78), each of said side portions (54) having a first pocket (82) therein about said cylinder passage (70) and facing said spool bore (78), a first valve seat (84) disposed in said first pocket (82) and engaging said central portion (54), said check valve (72) being a ball disposed in said cylinder passage (70), a spring reacting between the side portion and said ball for urging said ball into sealing engagement with said first valve seat (84), said central portion (54) having a relief cavity (92) extending therethrough between said side portions (54), each of said side portions (54) having a relief passage (94) communicating between said cylinder passage (70) and said relief cavity (92) in said central portion (54), each side portion (54) having a second pocket therein about said relief passage (94) and facing said relief cavity (92), a second valve seat (96) disposed in said second pocket and engaging said central portion (54), a relief (98) disposed in each end of said relief cavity (92) and engaging said second valve seat (84), said central portion (54) having passages (100, 101) therein communicating between said shuttle bore (74) and said spool bore (78) and controlled by said shuttle valve means (76), said central portion (52) including a reservoir inlet passage (62) extending to a first opening into said tube (32) and a pump outlet passage extending from a second opening into said tube (32) to the pump return outlet (18), and a passage (58) between said relief cavity (97) and said reservoir inlet passage (62), said spool valve means (80) including extensions from each end thereof for opening said check valves (72).

2. An assembly as set forth in claim 1 further characterized as including a plurality of tie rods (50) interconnecting said cap member (34) and said valve body (36) for urging said cap member (34) and valve body (36) into engagement with said ends of said tube (32).

3. An assembly as set forth in claim 2 further characterized by each of said cap member (34) and said valve body (36) including an insert portion (38, 42) extending into and in sealing engagement with the interior of said tube (32) adjacent the respective ends thereof.

4. An assembly as set forth in claim 3 further characterized by each of said cap member (34) and said valve body (36) including an abutment flange (46, 48) extending from said insert portion (38, 42) and engaging the respective end surfaces of said tube (32).

5. An assembly as set forth in claim 4 further characterized by said tie rods (50) extending through said flanges (46, 48).

6. An assembly as set forth in claim 5 further characterized by said tube (32) being a cylinder with said insert portions (38, 42) being circular and said abutment flanges (46, 48) being four-sided to define corners with one of said tie rods (50) extending through each of said corners.

7. An assembly as set forth in claim 1 further characterized by said side portions (54) being made of a plastic material and including a metal connector (86) at each of said pump inlet (68) and cylinder passages (70), each connector (86) having one end embedded in said plastic material and the other end extending therefrom and adapted to be connected to a fluid line.

8. An assembly as set forth in claim 1 further characterized by said reservoir having a top and being closed, filling means (104, 106) in said top of said reservoir for filling said reservoir with hydraulic fluid and for pressurizing said reservoir with a gas.

9. An assembly as set forth in claim 8 further characterized by including a pressure gauge means (108, 108') for indicating the pressure in the system.

10. An assembly as set forth in claim 9 further characterized by said pressure gauge means (108) being disposed at said top of said reservoir.

11. An assembly as set forth in claim 8 further characterized by including first (12) and second (12') steering pumps with each having port (14, 14') and starboard (16, 16') fluid outlets and a return inlet (18, 18'), said control valve means (36) interconnecting said port outlets (14, 14') of said steering pumps (12, 12') to said port inlet (24) of said steering cylinder (20) and said starboard outlets (16, 16') of said pumps (12, 12') to said starboard inlet (26) of said steering cylinder (20) and including a return line (18, 18') connected to said return inlets of said pumps, and flow divider means (120, 122, 124, 126, 127, 128, 130) between said control valve means (36) and said steering pumps (12, 12') for preventing the nonactive steering pump from motoring in response to steering fluid output of the active steering pump while allowing a limited amount of the steering fluid output to flow to the nonactive steering pump.

12. An assembly as set forth in claim 11 further characterized by said flow divider means including a first shuttle-tee check valve (120) having a first valve passage interconnecting said port outlets (14, 14') of said steering pumps (12, 12') and a first outlet (121) connected to said control valve means (36) with a first valve member (122) movable back and fourth to close the first valve passage to the port outlet of the inactive pump in response to fluid output from the port outlet of the active pump, and a second shuttle-tee check valve (124) having a second valve passage interconnecting said starboard outlets (16, 16') of said steering pumps (12, 12') and a second outlet (125) connected to said control valve means (36) with a second valve member (126) movable back and forth to close the second valve passage to the starboard outlet of the inactive pump in response to fluid output from the starboard outlet of the active pump.

13. An assembly as set forth in claim 12 further characterized by said flow divider means including a first bypass passage (127) interconnecting said port outlets (14, 14') for allowing a restricted flow of fluid to bypass said first shuttle-tee check valve (120) and a second bypass passage (128) interconnecting said starboard outlets (16, 16') for allowing a restricted flow of fluid to bypass said second shuttle-tee check valve (124).

14. An assembly as set forth in claim 13 further characterized by each of said bypass (127, 128) passages including a calibrated flow control (130) for limiting flow rate to a predetermined range.

15. An assembly as set forth in claim 14 further characterized by said fluid reservoir being pressurized for supplying fluid and pressurizing said system.

16. An assembly as set forth in claim 15 further characterized by said control valve means (36) including a shuttle bore (74) with the ends thereof communicating with said outlets (121, 125) of said shuttle-tee check valves, (120, 124) a pair of shuttle members (76) slidably disposed in said shuttle bore (74) for controlling flow therethrough.

17. A hydraulic control assembly for use in a marine steering system of the type having at least two steering pumps (12, 12') with each having port (14, 14') and starboard (16, 16') fluid outlets and a return inlet (18, 18'), a steering cylinder (20) with a piston (22) therein and port (24) and starboard (26) inlets for hydraulically moving the piston (22) back and forth in the cylinder (20) in response to fluid delivered from the pumps (12, 12'), control valve means (36) interconnecting said port outlets of said pumps (12, 12') to said port inlet (24) of said steering cylinder (20) and said starboard outlets (16, 16') of said pumps (12, 12') to said starboard inlet (26) of said steering cylinder (20) and including a return line (18, 18') connected to said return inlets of said pumps (12, 12') for controlling fluid flow between the pumps (12, 12') and the steering cylinder (20), said assembly being characterized by including flow divider means (120, 122, 124, 126, 127, 130) between said control valve means (36) and said steering pumps (12, 12') for preventing the nonactive steering pump from motoring in response to steering fluid output of the active steering pump while allowing a limited amount of the steering fluid output to flow to the nonactive steering pump, said flow divider means including a first shuttle-tee check valve (120) having a first valve passage interconnecting said port outlets (14, 14') of said steering pumps (12, 12') and a first outlet (12') connected to said control valve means (36) with a first valve member (122) movable back and forth to close the first valve passage to the port outlet of the inactive pump in response to fluid output from the port outlet of the active pump, and a second shuttle-tee check valve (124) having a second valve passage interconnecting said starboard outlets (16, 16') of said steering pumps (12, 12') and a second outlet (125) connected to said control valve means (36) with a second valve member (126) movable back and forth to close the second valve passage to the starboard outlet of the inactive pump in response to fluid output from the starboard outlet of the active pump.

18. An assembly as set forth in claim 17 further characterized by said flow divider means including a first bypass passage (127) interconnecting said port outlets (14, 14') for allowing a restricted flow of fluid to bypass said first shuttle-tee check valve (120) and a second bypass passage (128) interconnecting said starboard outlets (16, 16') for allowing a restricted flow of fluid to bypass said second shuttle-tee check valve (124).

19. An assembly as set forth in claim 18 further characterized by each of said bypass passages (127, 128) including a calibrated flow control (130) for limiting flow rate to a predetermined range.

* * * * *